United States Patent [19]

Graziadei

[11] Patent Number: 5,076,218

[45] Date of Patent: Dec. 31, 1991

[54] CONSTANT VELOCITY INTAKE MANIFOLD

[76] Inventor: Richard Graziadei, 10515 Lake Dr., Seminole, Fla. 34642

[21] Appl. No.: 690,346

[22] Filed: Apr. 24, 1991

[51] Int. Cl.[5] ..... F02M 35/10

[52] U.S. Cl. ..... 123/52 MC; 123/73 V; 123/590

[58] Field of Search ..... 123/52 M, 52 MC, 52 MB, 123/73 V, 579, 580, 590, 73 B, 73 A

[56] References Cited

U.S. PATENT DOCUMENTS

| | | | |
|---|---|---|---|
| 3,109,416 | 11/1963 | Rose et al. | 123/52 MV |
| 3,895,617 | 7/1975 | Sakurai | 123/579 |
| 4,474,145 | 10/1984 | Boyesen | 123/73 V |
| 4,690,107 | 9/1987 | Emler et al. | 123/73 V |
| 4,711,225 | 12/1987 | Holderle et al. | 123/590 |
| 4,739,732 | 4/1988 | Nakamura | 123/73 V |
| 4,879,976 | 11/1989 | Boyesen | 123/73 V |

FOREIGN PATENT DOCUMENTS

| | | | |
|---|---|---|---|
| 0083630 | 5/1982 | Japan | 123/52 M |
| 0062317 | 4/1983 | Japan | 123/52 M |

*Primary Examiner*—David A. Okonsky

*Attorney, Agent, or Firm*—Walter J. Monacelli

[57] ABSTRACT

The constant velocity intake manifold is designed to provide an increased velocity of the fuel-air mixture into the reed valve (engine inlet port) of a two-cycle engine. The present design of feeding device transmitting the fuel-air mixture eminating from the carburetor into the manifold has a passageway of such considerable cross-sectional area that the linear velocity of the mixture is decreased considerably. The device described herein reduces this passageway cross-sectional area to increase the linear velocity of the mixture passing therethrough. The new manifold has an extension which reaches into the adjoining reed valve cage to also reduce the cross-sectional area of the passageway feeding into this cage and thereby increases the linear velocity of the fuel-air mixture passing into this cage.

5 Claims, 6 Drawing Sheets

CONSTANT VELOCITY INTAKE MANIFOLD

BACKGROUND OF THE INVENTION

1. Field of the Invention

This invention relates to a specifically designed manifold for producing an increased linear velocity. More specifically this manifold is designed with a passageway chamber of reduced cross-sectional area so as to increase the linear velocity of the fuel-air mixture passing therethrough. Still more specifically this invention is particularly adaptable to two-cycle engines having a reed type check valve in the manifold.

2. State of the Prior Art

In two-cycle combustion engines there is generally a manifold having a reed type check valve into which the fuel-air mixture coming from the carburetor is channeled into the cylinders in which the mixture is to be exploded in order to drive the pistons. In many cases the channel into which the fuel-air mixture is fed has such a great cross-sectional area that the linear velocity of the fuel-air mixture is reduced more than desired. To overcome this condition many operators have placed plastic inserts into the two halves of the manifold to reduce the cross-sectional area of this channel and therefore increase the linear velocity of the fuel-air mixture passing therethrough. However these plastic inserts often do not fit snugly into the channel, or deteriorate after a period of use and become less effective.

A number of patents on two-cycle internal combustion engines have been examined such as U.S. Pat. Nos. 4,194,470; 4,202,300; 4,357,916; 4,440,697; 4,592,311 and 4,970,996. None of these patents show a two-component manifold for feeding the fuel-air mixture from the carburetor into the cylinders which has a constricted or reduced volume in the flow chamber adapted to increase the linear velocity of the fuel-air mixture passing therethrough.

OBJECTIVES

It is an object of this invention to provide a manifold design which effects an increased linear velocity of the fuel-air mixture in a two-cycle internal combustion engine.

It is also an object of this invention to provide such a manifold design in a two-cycle internal combustion engine having a reed type check valve in engine inlet port.

It is also an object of this invention to provide such a manifold design in which the channel has a decreased cross-sectional area whereby an increased linear velocity is effected on the fuel-air mixture passing therethrough.

It is also an object of this invention to provide an integrated manifold in which said reduced cross-sectional area Other objects will become obvious upon reading the detailed description of the invention as given hereinafter.

SUMMARY OF THE INVENTION

In accordance with the present invention, an improved manifold for a two-cycle internal combustion engine has been designed. This manifold has a reduced cross-sectional area in the passageway for the fuel-air mixture and has an extension from the exit port opening or openings which serve to reduce also the cross-sectional area of the entrance into the adjoining reed valve cage. This reduced cross-sectional area in both the manifold and in the entrance to the cage produces a desired increase in the linear velocity of the fuel-air mixture passing therethrough.

This increase in linear velocity of the fuel-air mixture helps to produce a broader power band and greater throttle response. The integrated manifold and reed valve booster design can be applied to any reed valve inducted two cycle engine to improve engine performance.

BRIEF DESCRIPTION OF THE DRAWINGS

The description of the invention is facilitated by reference to the drawings.

DESCRIPTION OF THE PREFERRED EMBODIMENTS

Figure 1:
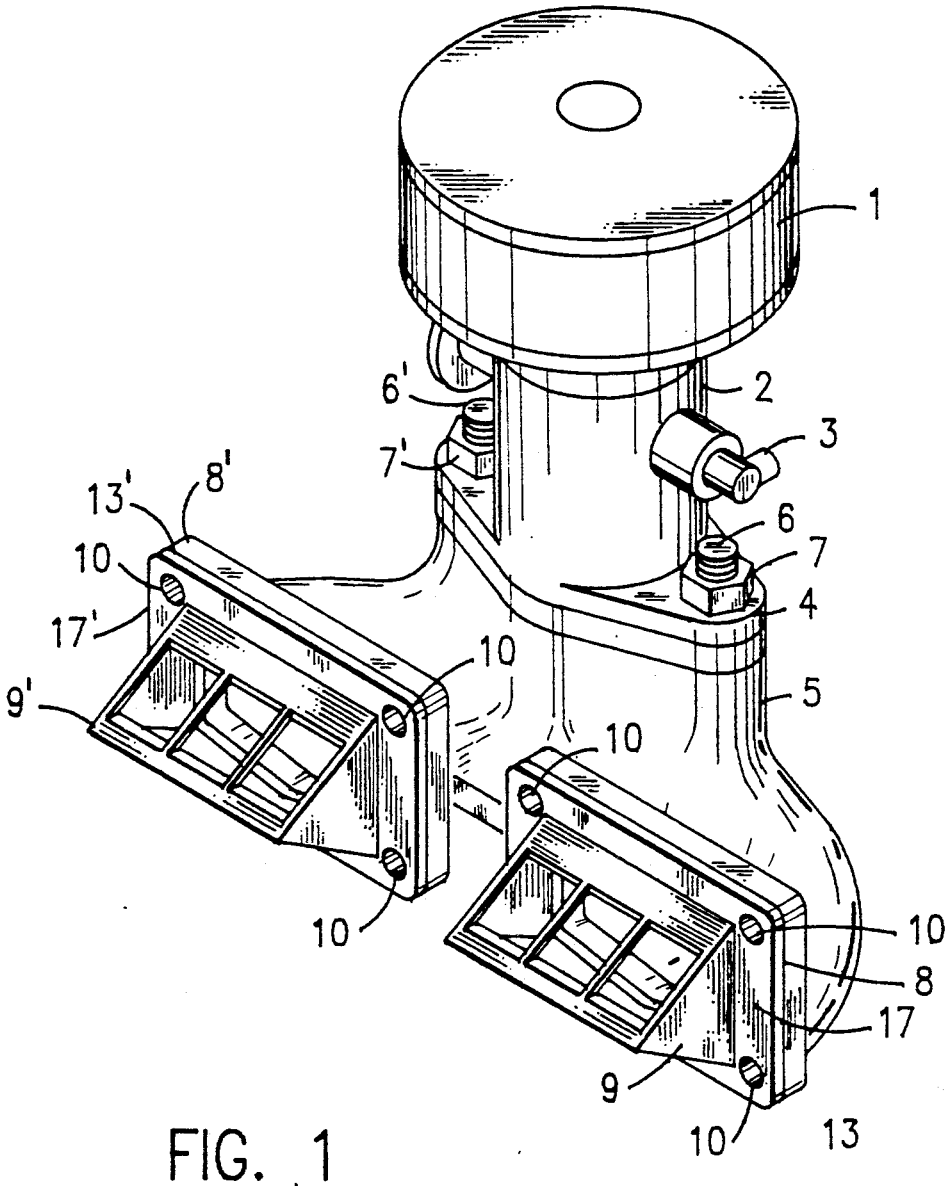
FIG. 1 PRIOR ART
FIG. 1 is a perspective view of a prior arc assembly of air filter, carburetor with double outlet and a double outlet manifold.

In the prior art assembly shown in FIG. 1, air filter rests on top of carburetor 2 which has fuel inlet 3 and base plate 4. Carburetor 2 has an opening (not shown) in the bottom thereof which feeds the fuel-air mixture through an opening (not shown) in the middle of base plate 4 and into the top of manifold 5. Base plate 4 is fastened tightly to the top of manifold 5 by means of bolts 6 and 6' and nuts 7 and 7'. Ports and 8' have outlet openings (not visible in this view) which feed into reed valve cages 9 and 9'. Fasteners 10 hold the reed cage mounts 17 and 17' tightly against port plates 8 and 8' preferably with a gasket therebetween.

Figure 2:
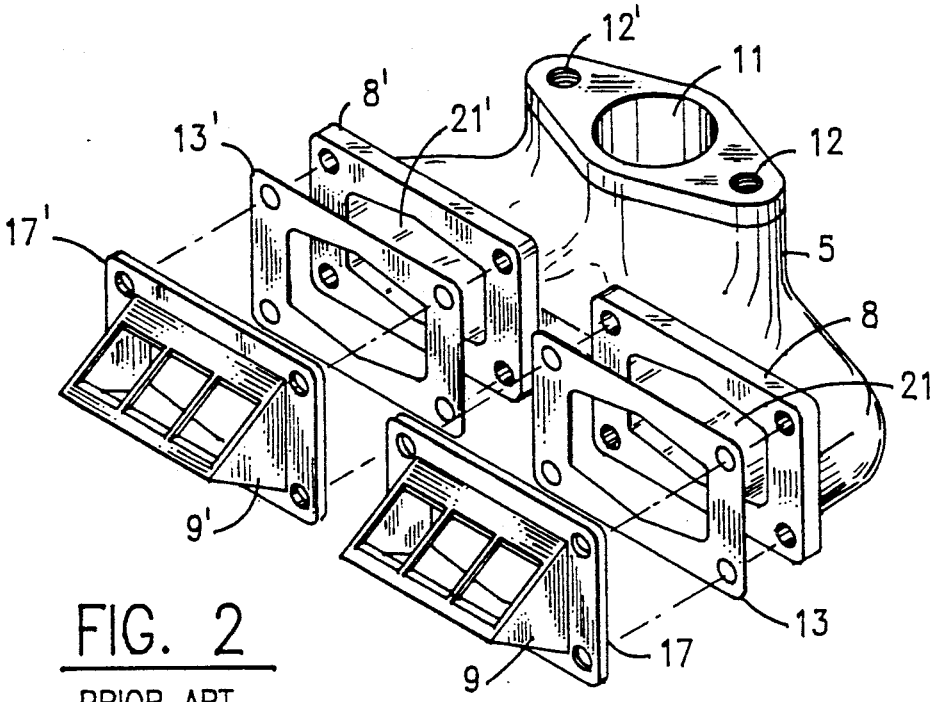
FIG. 2 PRIOR ART
FIG. 2 is an exploded view of the prior art assembly of FIG. 1.

In the exploded view of FIG. 2, inlet 11 is at the top of manifold 5 and threaded openings 12 and 12' are provided to accommodate the bolts 6 and 6' shown in FIG. 1. Port openings 21 and 21' are provided for the passage of the fuel-air mixture from the manifold 5 into reed valve cage 9 and 9'. Gaskets 13 and 13' are provided to effect a tight seal of reed valve cage mounts 17 and 17' and 9 and 9' with ports 8 and 8'.

Figure 3:
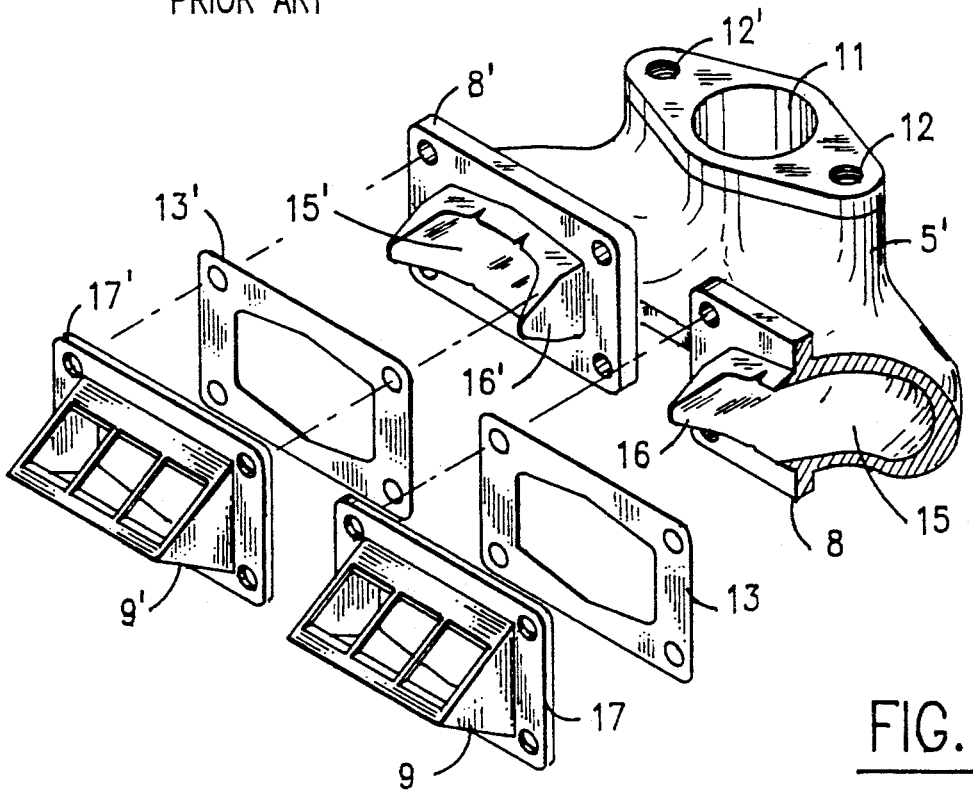
FIG. 3 is an exploded view similar to that of FIG. 2 except that it includes a preferred modification of the improved manifold of this invention.

FIG. 3 shows a preferred manifold of this invention in which passageway 11 has been divided into two subpassageways 15 and 15' and the cross-sectional areas of subpassageways 15 and 15' have been reduced from that provided in the prior art manifold and extensions 16 and 16′ are provided to effect a reduced cross-sectional area into the interior of reed valve cages 9 and 9′. This reduced cross-sectional area effects an increased linear velocity in the fuel-air mixture passing through the improved manifold of this invention.

Figure 4:
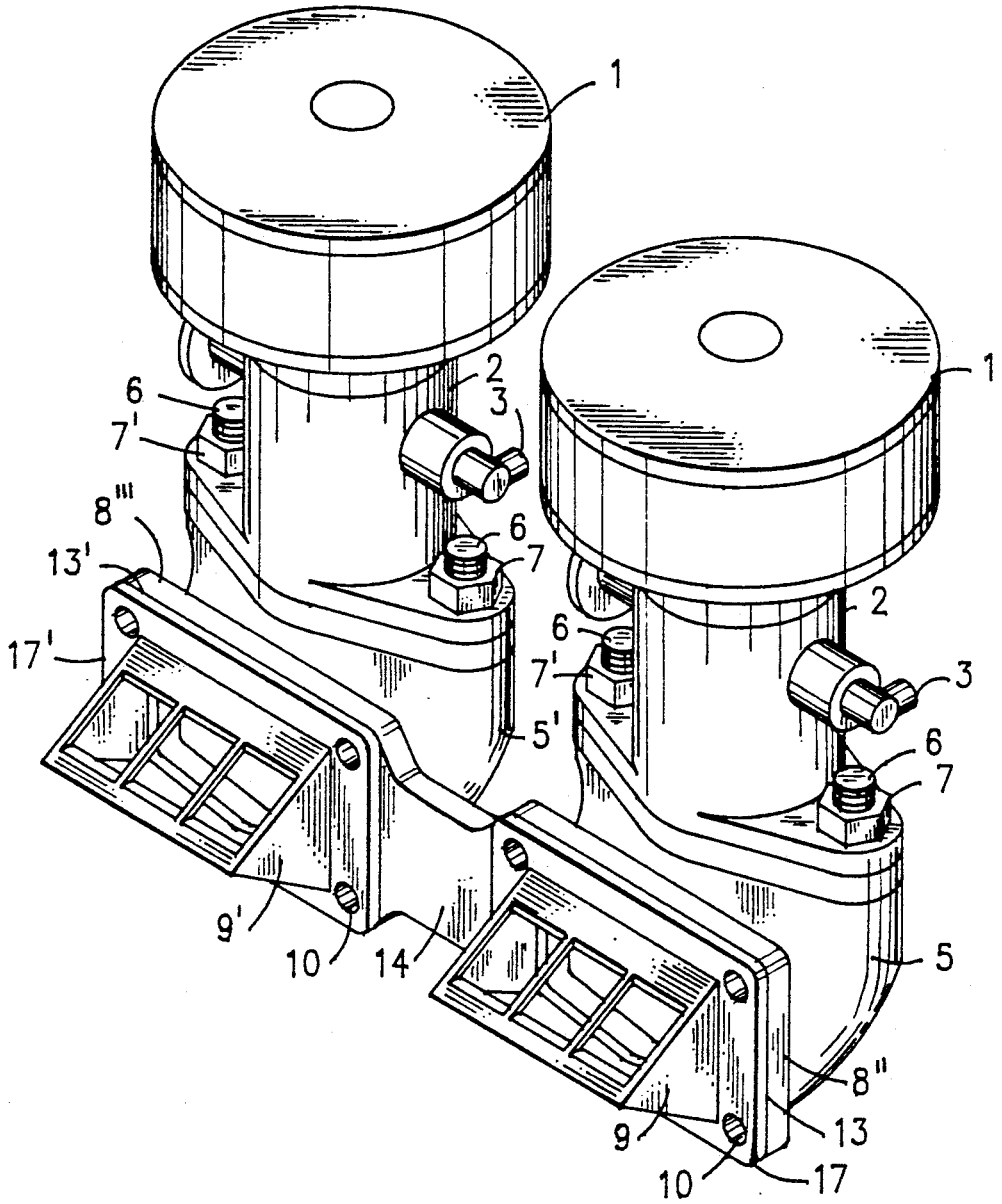
FIG. 4 is a perspective view of a double carburetor assembly connected to an integrated double manifold of this invention.

FIG. 4 shows a double carburetor with integrated two manifolds having an integrated plate 14 which has port plates 8″ and 8‴ for fastening to reed valve cage mounting plates 17 and 17′ with ports (not shown in this view) feeding into two reed valve cages 9 and 9′.

Figure 5:
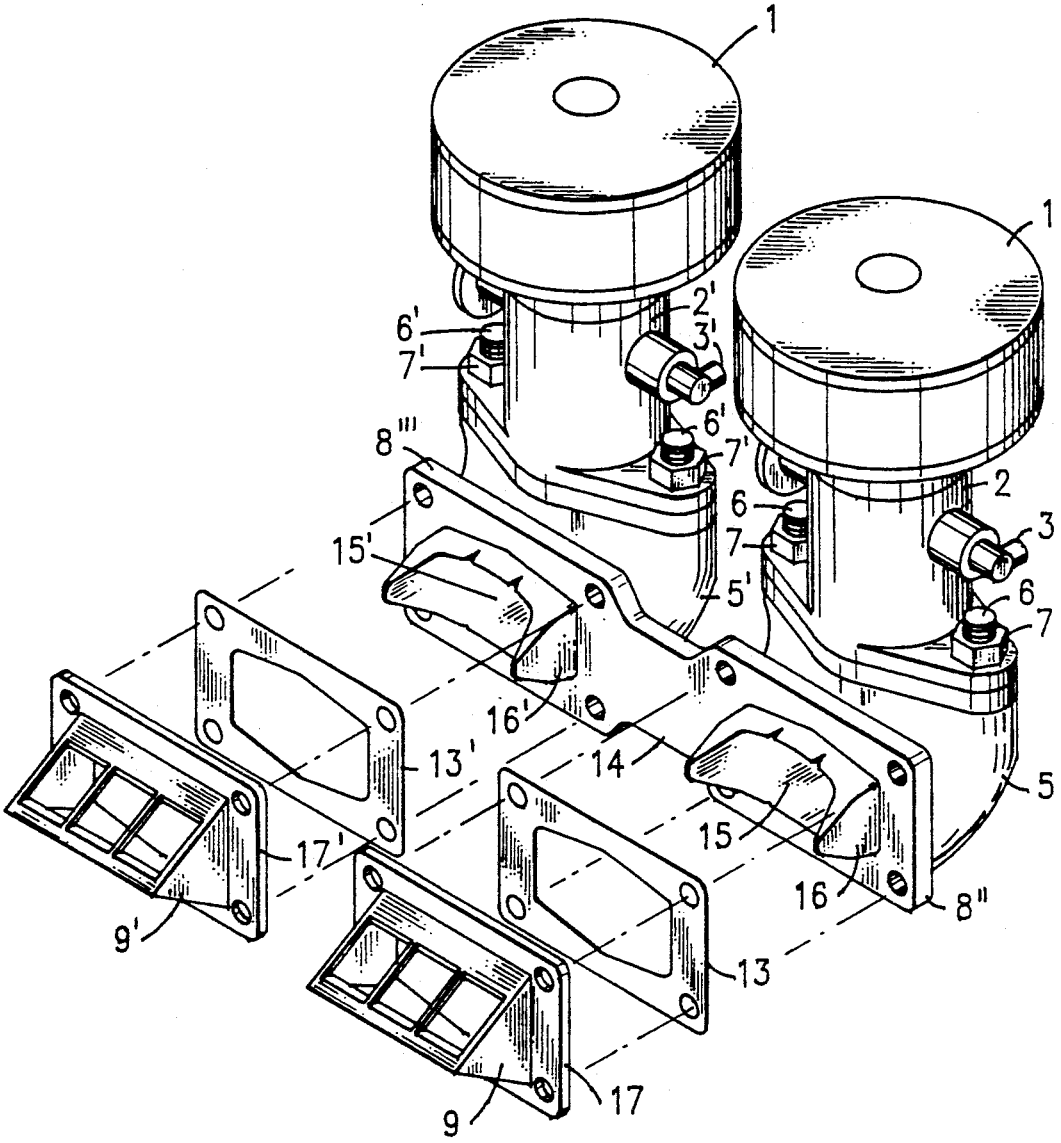
FIG. 5 is an exploded view of the assembly of FIG. 4.

FIG. 5 is an exploded view of the arrangement of FIG. 4 showing the integrated arrangement of a double manifold with extensions 16 and 16′ which extend into reed valve cages 9 and 9′ and reduce the cross-sectional areas of the passageways therein.

Figure 6:
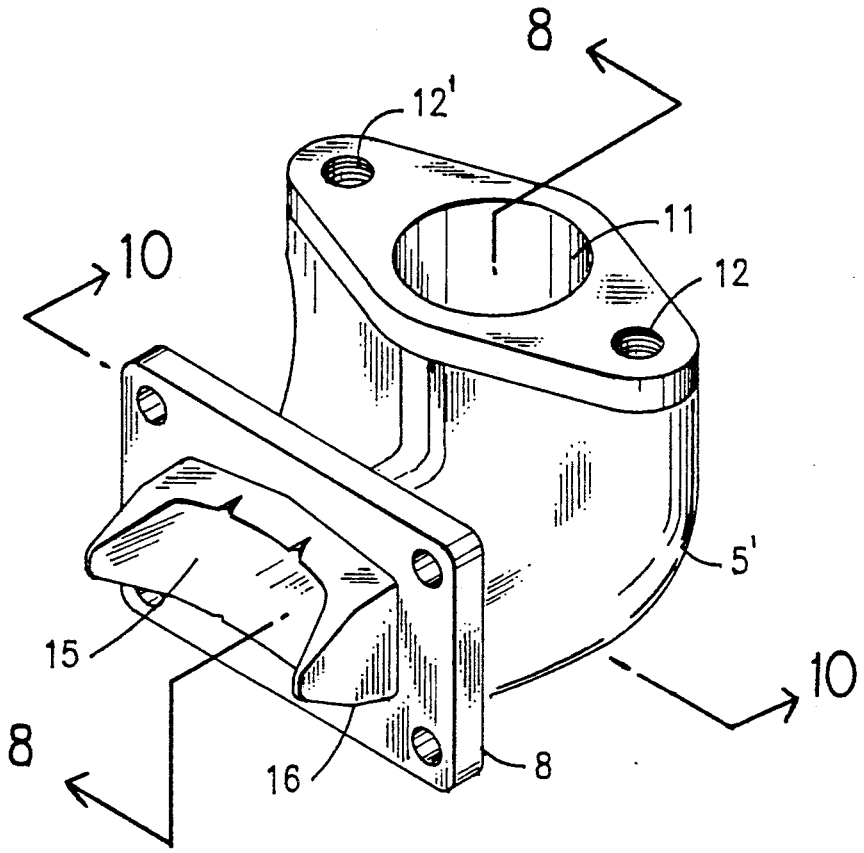
FIG. 6 is a perspective view of a preferred modification of a single manifold of this invention.

FIG. 6 is a perspective view of a single manifold with a single port outlet.

Figure 7:
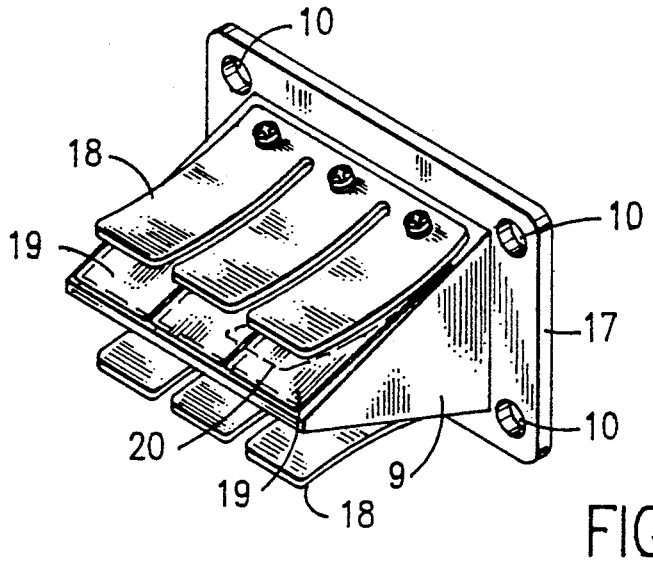
FIG. 7 is a perspective view of a reed valve cage used in combination with the manifold of this invention.

FIG. 7 is a perspective view of a reed valve cage 9 with mounting plate 17 for attachment to a manifold. Catches 18 are provided to prevent reeds 19 from opening beyond a predetermined amount. One reed is shown in a phantom position 20 when the reed is fully opened while the fuel-air mixture is passing through the valve.

Figure 8:
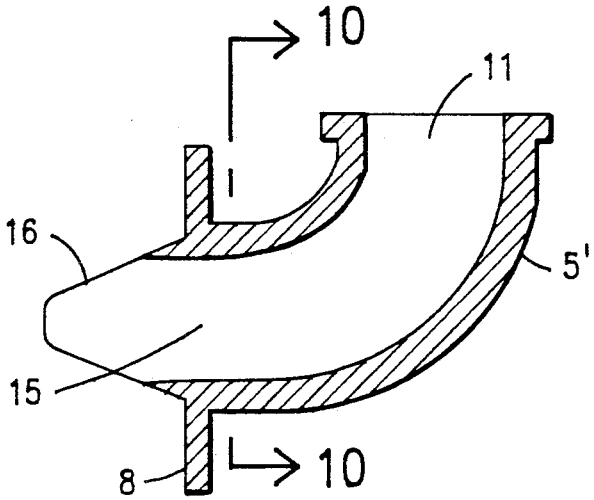
FIG. 8 is a cross-sectional view of an improved manifold of this invention taken at line 8—8 of FIG. 5.

FIG. 8 is a cross-sectional view of the manifold of FIG. 6 taken at line 8—8. A comparison of FIG. 8 with that of FIG. 9, which shows a similar cross-sectional view of a prior art manifold shows a reduced diameter and consequently a reduced cross-sectional area which results in an increased linear velocity of the fuel-air mixture passing through the manifold, as compared with the larger cross-sectional area of the passageway 15″ at the prior art manifold.

The various drawings show an angle of 9O° between the plane of the top surface of the manifold, which is to be positioned against base plate 4 at the bottom of the carburetor, and the plane of the mounting plates 8 and 8′. This means that the direction of the fuel-air mixture emanating from carburetor will be turned 9O° from its original direction. This 9O° angle has been shown since it simplifies the drawings. However various other angles may be selected between the specified planes. In many cases it is preferred to have designs in which mounting plates are positioned so that the direction of flow is changed only 45° instead of the 9O° angle shown. The particular angle is not critical and is selected as a matter of convenience.

Figure 9:
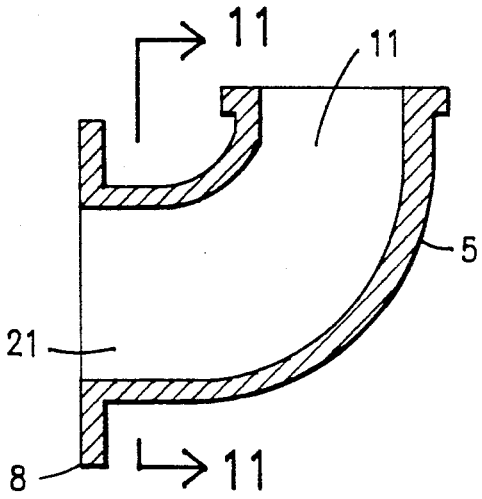
FIG. 9 PRIOR ART
FIG. 9 is a cross-sectional view similar to that of FIG. 6 but taken of a prior art manifold.
Figure 10:
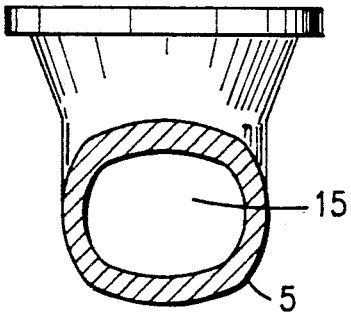
FIG. 10 is a cross-sectional view taken at line 10—10 of FIGS. 6 and 8.
Figure 11:
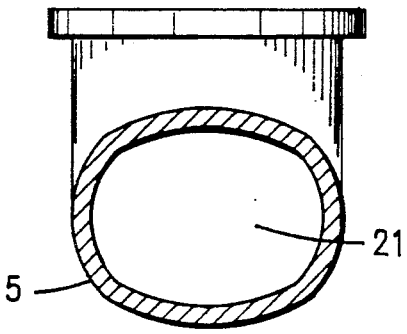
FIG. 11 PRIOR ART
FIG. 11 is a cross-sectional view corresponding to that shown in FIG. 10 but taken of a prior art manifold, for example taken at line 11—11 of FIG. 9.

FIG. 10 shows the reduced cross-sectional area of the manifold of this invention taken at line 10—10 of FIG. 8 as compared with the larger cross-sectional area of a prior art manifold as shown in FIG. 11 which is taken at line 11—11 of FIG. 9. This cross-sectional area in the manifold of this invention is roughly about one-half that of the prior art cross-section.

As described above the manifold of this invention provides an integrated unit which when inserted between the carburetor and the reed valve cage of a two-cycle internal combustion engine can increase the linear velocity of the fuel-air mixture being fed into the engine. This increased linear velocity is effected as the result of the decreased cross-sectional area of the passageway in the manifold as the mixture is fed from the manifold. Where reference is made to the "cross-sectional area of the passageway" it is intended to mean that area taken in a plane perpendicular to the direction of flow through the passageway or perpendicular to the longitudinal axis of the passageway. While the exact increase in linear velocity will depend on the specific dimensions of the manifold passageway, it is generally possible to decrease the cross-sectional area of the passageway in the manifold to about one-half the corresponding cross-section of a corresponding prior art manifold passageway and thereby roughly double the linear velocity through the manifold.

While the manifold of this invention is particularly useful with reed boosters, it is not limited to use with reed boosters but may be used with other valve controls.

The manifold design of this invention helps to produce a broader power band and greater throttle response. It will also aid in eliminating intake track surface gaps and misalignment often encountered when separate reed boosters are used.

While certain features of this invention have been described in detail with respect to various embodiments thereof, it will of course be apparent that other modifications can be made within the spirit and scope of this invention and it is not intended to limit the invention to the exact details shown above except insofar as they are defined in the following claims.

The invention claimed is:

1. An intake manifold particularly suited for use between the carburetor and the reed valve cage in two-cycle internal combustion engines comprising:

(a) a manifold having an inlet opening at a first end of said manifold and an outlet opening at a second end of said manifold, said manifold having a passageway therethrough connecting said inlet and said outlet openings;

(b) a first mounting plate at said first end of said manifold and capable of being tightly fitted to the outlet end of a carburetor designed to deliver a fuel-air mixture into said manifold passageway, said mounting plate having said inlet opening therein for reception of said fuel-air mixture into said manifold passageway;

(c) a second mounting plate at said second end of said manifold capable of being tightly fitted to the inlet end of a reed valve cage for an internal combustion engine, said mounting plate having an extension therefrom shaped to reach into the interior of said reed valve cage and said extension having the said outlet opening therein capable of feeding said fuel-air mixture into the interior of said reed valve cage; and (d) the said extension having in said opening which serves to feed fuel-air mixture into the interior of said reed valve cage a reduced cross-sectional area as compared with the cross-sectional area of the said interior of said reed valve cage absent said extension.

2. The manifold of claim 1 in which said passageway of said manifold has, at the region where said extension extends beyond the said second mounting plate, a cross-sectional area approximately equal to the cross-sectional area of the passageway through said extension.

3. The manifold of claim 1 in which there is a single passageway passing through said manifold and having one said extension capable of being joined to one said reed valve cage.

4. The manifold of claim 1 in which said passageway in said manifold is divided into two subpassageways each of which subpassageways has a said extension and a said mounting plate for junction with a reed valve cage.

5. The manifold of claim 1 in which said second mounting plate at said second end of said manifold is one of a pair of mounting plates joined into one integrated double mounting plate each of said mounting plates in said pair having a said extension adapted to reach into a said reed valve cage, whereby said integrated double mounting plate is capable of being joined to two manifold passageways and said integrated mounting plate is capable of being attached to two reed valve cages with a said extension reaching into each said reed valve cage, said manifold being capable of being attached to two carburetors and capable of feeding a fuel-air mixture into each of said two reed valve cages.

* * * * *

UNITED STATES PATENT AND TRADEMARK OFFICE

CERTIFICATE OF CORRECTION

PATENT NO. : 5,076,218

DATED : December 31, 1991

INVENTOR(S) : Richard Graziadei

It is certified that error appears in the above-identified patent and that said Letters Patent is hereby corrected as shown below:

Col. 1, line 56, add "of the passageway channel is effected"

Col. 2, line 15, correct "arc" to read "art"

Col. 2, line 44, after "filter" insert "1"

Col. 2, line 51, after "Ports" insert "8"

Signed and Sealed this

Sixteenth Day of March, 1993

*Attest:*

STEPHEN G. KUNIN

*Attesting Officer*

*Acting Commissioner of Patents and Trademarks*